United States Patent [19]

Kovarik et al.

[11] Patent Number: 4,728,862

[45] Date of Patent: Mar. 1, 1988

[54] A METHOD FOR ACHIEVING IGNITION OF A LOW VOLTAGE GAS DISCHARGE DEVICE

[75] Inventors: Vincent J. Kovarik, Bohemia; Ady Hershcovitch, Mt. Sinai; Krsto Prelec, Setauket, all of N.Y.

[73] Assignee: The United States of America as represented by the United States Department of Energy, Washington, D.C.

[21] Appl. No.: 386,370

[22] Filed: Jun. 8, 1982

[51] Int. Cl.[4] ..... H01J 7/24; H05B 31/26

[52] U.S. Cl. ..... 315/111.01; 313/161; 313/231.31; 315/111.41; 315/111.81

[58] Field of Search ..... 315/111, 111.41, 111.81, 315/111.91, 344; 313/161, 337, 231

[56] References Cited

U.S. PATENT DOCUMENTS

| | | | |
|---|---|---|---|
| 2,146,025 | 2/1937 | Penning | 315/161 X |
| 2,197,079 | 4/1940 | Penning | 315/344 X |
| 2,668,260 | 2/1954 | Barnett et al. | 315/111.91 |
| 2,928,966 | 3/1960 | Neidigh | 313/230 X |
| 3,405,301 | 10/1968 | Hayakawa et al. | 315/111.41 |
| 3,440,475 | 4/1969 | Schiller et al. | 313/337 |
| 3,831,052 | 8/1974 | Knechtli | 313/231 |
| 3,845,344 | 10/1974 | Ranier | 313/231 |
| 4,264,843 | 4/1981 | Hammersand | 315/39.51 |
| 4,339,691 | 7/1982 | Morimiya et al. | 315/111.41 |
| 4,344,019 | 8/1982 | Gavin et al. | 315/111.81 |
| 4,423,355 | 12/1983 | Kageyama | 315/111.81 |

OTHER PUBLICATIONS

Prelec et al., *High Current, Steady State $H^-$ ($D^-$) on Sources for Fusion Applications,* 1981, IEEE International Conference on Plasma Science, Los Alamos, N. Mex. (May 18–20, 1981).

*Primary Examiner*—Saxfield Chatmon

*Attorney, Agent, or Firm*—Vale P. Myles; Paul A. Gottlieb; Judson R. Hightower

[57] ABSTRACT

An electronic device of the type wherein current flow is conducted by an ionized gas comprising a cathode of the type heated by ionic bombardment, an anode, means for maintaining a predetermined pressure in the region between the anode and the cathode and means for maintaining a field in the region. The field, which is preferably a combined magnetic and electric field, is oriented so that the mean distance traveled by electrons before reaching the anode is increased. Because of this increased distance traveled electrons moving to the anode will ionize a larger number of gas atoms, thus reducing the voltage necesary to initiate gas breakdown. In a preferred embodiment the anode is a main hollow cathode and the cathode is a smaller igniter hollow cathode located within and coaxial with the main hollow cathode. An axial magnetic field is provided in the region between the hollow cathodes in order to facilitate gas breakdown in that region and initiate plasma discharge from the main hollow cathode.

3 Claims, 5 Drawing Figures

A METHOD FOR ACHIEVING IGNITION OF A LOW VOLTAGE GAS DISCHARGE DEVICE

BACKGROUND OF THE INVENTION

The United States Government has rights in this invention pursuant to Contract Number DE-AC02-76CH00016, between the United States Department of Energy and Associated Universities, Inc.

The subject invention relates to gas discharge devices and more particularly to gas discharge devices having improved ignition characteristics.

In a gas discharge device, most of the electric current is carried by electrons in a plasma formed between the cathode and anode. Therefore, in order to maintain an ongoing discharge, electrons have to be supplied to, or created in the plasma at a rate sufficient to compensate for the loss of electrons due to diffusion, etc. In hot cathode discharges, most of the electrons are emitted by the hot cathode. Usually, these cathodes operate at temperatures exceeding 2200° C. These high temperatures are maintained by either a heater, or by ion bombardment since positive ions are attracted to the cathode.

Initiation of such discharges can be achieved either by physically heating the cathode with a heater, or by causing electrical breakdown of the gas; creating positive ions, which in turn strike and heat the cathode. Once the cathode reaches the critical temperature it emits electrons and the desired discharge is established.

In the type of device where the cathode is heated by ion bombardment, initial gas breakdown or ignition, can be achieved by the application of voltages between the electrodes. Microscopically, some initial electrons are created in the system (usually by cosmic rays). These electrons are accelerated by the applied electric fields and then collide with the gas atoms and molecules, thus creating more electrons. This process is called multiplication. And, if this multiplication is large enough, gas breakdown, or ignition, occurs. For a given voltage between electrodes, this process depends on the product of the gas density, i.e. pressure P, and the interelectrode distance d. A typical curve of the breakdown voltage, $V_s$, as a function of the product Pd is shown in FIG. 1. Such curves are known to those skilled in the art as Paschen curves.

In devices of interest, Pd is very small (i.e. substantially to the left of the minimum of the Paschen curve) due to extremely small d and a low value of P. Therefore, in order to initiate discharges in these devices by breakdown, very high voltages are required and in many cases the pressure must be raised in addition.

Thus, it is an object of the subject invention to provide gas discharge devices which require lower voltages (for a given value of the parameter Pd) to initiate gas breakdown.

BRIEF SUMMARY OF THE INVENTION

The objects of the subject invention are achieved and the disadvantages of the prior art are overcome in accordance with the subject invention by means of a gas discharge device which comprises a cathode of the type which is heated by ionic bombardment, an anode and means for maintaining a preselected gas pressure in the region between the anode and cathode.

Means for generating a field in the region between the anode and cathode are also provided. The field is oriented so that the mean distance traveled by an electron in the region before reaching the anode is increased, effectively increasing the value of Pd without changing the geometry of the device, and thus decreasing the voltage required to initiate gas breakdown in the device. (By fields herein is meant combinations of electric and magnetic fields).

The operation of gas discharge devices which embody the subject invention may best be understood by considering two general configurations which devices embodying the subject invention may have. The first, shown in simplified schematic form in FIG. 2, will hereafter be referred to as the magnetron configuration because of its similarities to magnetron devices, and is most suitable for devices with cylindrical geometry.

In a magnetron configuration as shown in FIG. 2, a substantially cylindrical cathode 20 is centered within and coaxial with a substantially cylindrical anode 22. A radial electric field E exists between anode 22 and cathode 20 and an axial magnetic field $\overline{B}$ is provided normal to electric field $\overline{E}$. In this configuration electrons in the region between anode 22 and cathode 20 spiral around cathode 20 before reaching anode 22, thus effectively increasing d, the separation between anode 22 and cathode 20.

The second general configuration to be considered, shown in simplified schematic form in FIG. 3, will hereinafter be referred to as the Penning configuration because of its similarities to Penning type ion sources and is most suitable for devices with planar geometry.

In a Penning configuration, as shown in FIG. 3, a pair of spaced cathodes, **30*a* and 30*b*, are adjacent and at substantially right angles to cylindrical anode 32 defining region 34. A magnetic field $\overline{B}$, substantially normal to cathode 30 and axial to anode 32, is provided in region 34. An electric field (not shown) whose configuration is determined by the exact geometry of anode 32 and cathodes 30 also exists in region 34. In this configuration electrons in region 34 will be confined by the magnetic field $\overline{B}$ and will tend to oscillate between cathodes 30*a* and 30*b* before reaching anode 32**.

(It should be noted that the study of the motion of charged particles in field is a well developed science well understood by those skilled in the art and the details of the design of particular embodiments of the subject invention would be well within the skill of such persons).

Consideration of the magnetron and Penning type devices described above shows that in both types of devices the distance traveled by electrons before they reach the anode is greatly increased by the field, thus effectively increasing Pd and reducing the voltage required to initiate gas breakdown. Thus, it may be seen that gas discharge devices in accordance with the subject invention advantageously provide for initiation of gas breakdown without the need for high voltages, heaters or temporary increases in gas pressure.

Other objects and advantages of the subject invention will become apparent to those skilled in the art from consideration of the attached drawings, and the detailed description set forth below.

DETAILED DESCRIPTION OF EMBODIMENTS OF THE INVENTION

Figure 4:
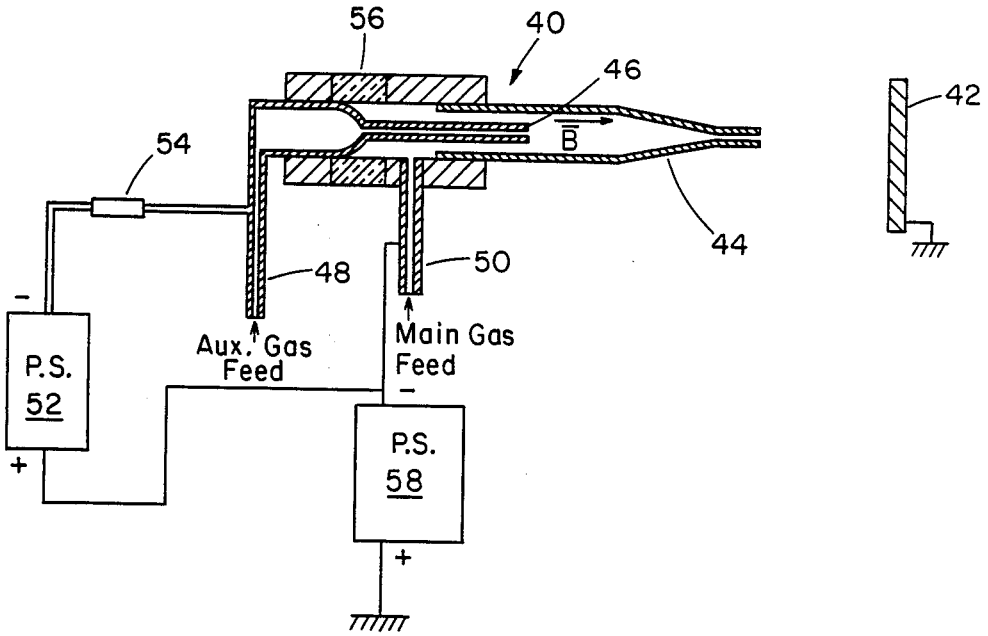
FIG. 4 is a semi-schematic illustration of an embodiment of the subject invention.

Turning to FIG. 4 there is shown an embodiment of the subject invention of the magnetron type comprising a hollow cathode discharge device. (Hollow cathode discharge devices (HCD's) are well known devices wherein a cathode in the form of a hollow tube is provided through which a stream of neutral gas flows. Once gas breakdown is initiated the HCD is heated by ionic bombardment and the discharge becomes self-maintaining.) Hollow cathode assembly 40 is spaced from and operatively associated with anode 42 and comprises main hollow cathode (MHC) 44 and igniter hollow cathode (IHC) 46. Both MHC 44 and IHC 46 are substantially cylindrical and approximately coaxial, though precise centering of IHC 46 is not critical. MHC 44 typically has a diameter of about 5.0 millimeters and IHC 46 typically has a diameter of about 0.3 millimeters.

MHC 44 and IHC 46 are each independently connected to a gas supply means (not shown), to maintain the desired pressures during operation of apparatus 40, through connections 48 and 50 respectively. A pump (not shown) is provided to maintain the desired pressure in the region between MHC 44 and anode 42. MHC 44 is held at a potential, preferably positive, with respect to IHC 46, of approximately 320 volts by power supply 52. Insulator 56 mechanically connects IHC 46 to MHC 44 to prevent a short circuit, and resistor 54, of approximately 50 ohms, is connected in series with power supply 52 for surge protection. MHC 44 is held at a potential of approximately −125 volts with respect to anode 42 by power supply 58. A magnetic field $\overline{B}$ is provided in the interior of MHC 44 by conventional means (not shown). This field combined with the electric field generated by power supply 52 provides the appropriate field to increase the efficiency of ion formation in the interior of MHC 44. Magnetic field $\overline{B}$ is preferably axial and approximately 100 Gauss, but the intensity and orientation are not critical.

To ignite MHC 44 the main gas feed through connection 50 and power supply 58 are turned off. The auxiliary gas feed through connection 48 and power supply 52 are turned on. A plasma will be formed in the interior of MHC 44 by IHC at a pressure in the approximate range of 1–5 millitorr. The main gas feed and power supply 58 are then turned on to transfer the plasma to MHC 44. The auxiliary gas feed and power supply 52 may then be turned off and the plasma will be maintained by MHC 44.

Figure 1:
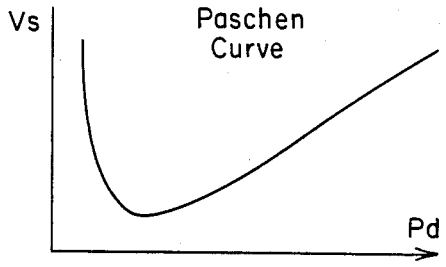
FIG. 1 is a typical plot of breakdown voltage vs. the parameter Pd, or Paschen curve.
Figure 2:
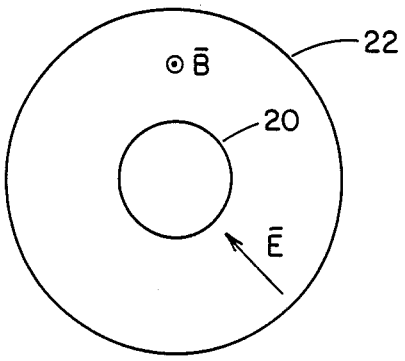
FIG. 2 is a schematic illustration of a genus of the subject invention.
Figure 3:
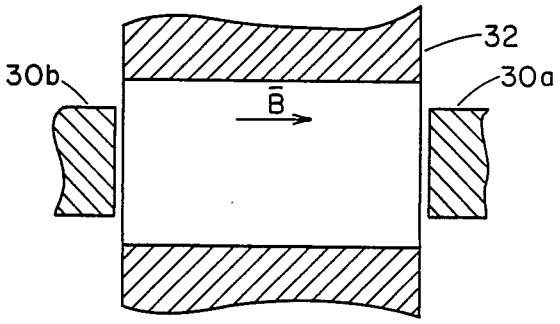
FIG. 3 is a schematic illustration of a second genus of the subject invention.
Figure 5:
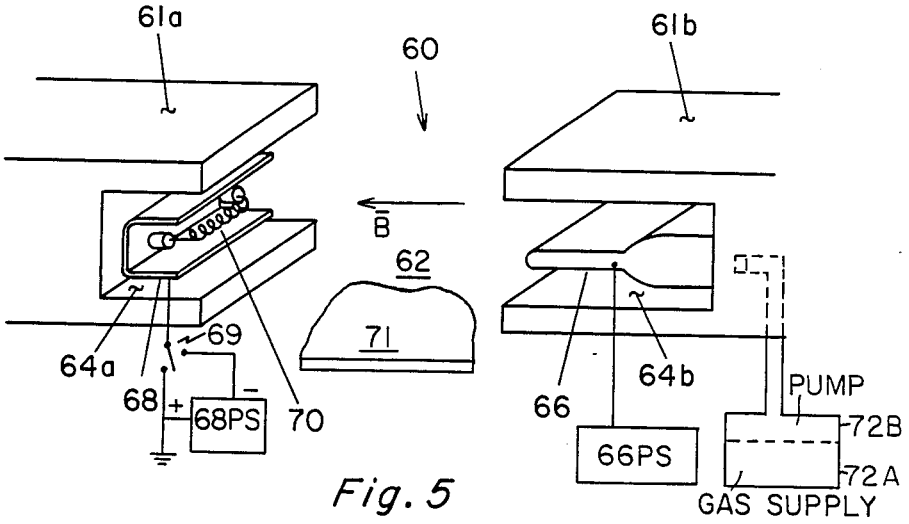
FIG. 5 is a semi-schematic illustration of a second embodiment of the subject invention.

Turning to FIG. 5, there is shown an embodiment of the subject invention of the Penning type which is suitable for the ignition of arrays of hollow cathodes, or flattened hollow cathodes, adapted to produce a plasma sheet. Apparatus 60 comprises magnet pole pieces **61*a* and 61*b* which provide a magnetic field $\overline{B}$ in region 62 and are provided with recesses 64*a* and 64*b* respectively. Hollow cathode (HC) 66, which is preferably a flattened rectangular hollow cathode adapted to produce a plasma sheet or a linear array of cylindrical hollow cathodes having a common gas feed, is positioned in recess 64*b* and serves as one cathode of a Penning configuration. Means (not shown) are provided to hold HC 66 at a potential of approximately −200 Volts, so that HC 66** functions as one cathode of a Penning configuration.

A heat shield 68, preferably formed of molybdenum and having the form of a C-channel open towards region 62, is positioned in recess **64*a*. Means (69) are provided whereby heat shield 68 may be switched between either a negative potential, preferably equal to the potential of HC 66, and a ground potential. When heat shield 68 is at the negative potential it functions as the second cathode of a Penning configuration. The anode 71 in the Penning configuration is provided by the grounded walls of the structure (not fully shown) which contains apparatus 60**.

To ignite HC 66, the gas supply 72A is turned on and heat shield 68 is switched to a negative potential. A pump (72B) is provided as a means to maintain the desired gas pressure during the operation of apparatus 60. Electrons in region 62 are confined by the $\overline{B}$ field and oscillate between heat shield 68 and HC 66. The oscillating electrons collide with neutral gas atoms to produce positive ions and more electrons until such time as the electrons diffuse through these collisions to the anode. Some of the positive ions will follow the $\overline{B}$ field lines and bombard HC 66, heating it. After a period, depending on the mass of HC 66 and its rate of heat loss, HC 66 will ignite and maintain a self-sustaining plasma discharge. Thus, the magnetic field $\overline{B}$ provided by pole pieces 61 combines with the electric field provided by power supply 66PS to HC 66 and the electric field provided by power supply 68PS to heat shield 68 to provide the appropriate field to increase the ionization efficiency of apparatus 60.

In a preferred embodiment filament 70 is mounted within the channel of heat shield 68. Connections (not shown) are provided so that filament 70 may be heated during the ignition process. By using filament 70 to provide electrons for the ignition process the necessary voltages and gas pressure are reduced.

Once HC 66 is ignited, filament 70 may be turned off and heat shield 68 switched to a ground potential. Heat shield 68 then functions as the anode for HC 66.

The foregoing description of a preferred embodiment of the invention has been presented for the purposes of illustration and description. It is not intended to be exhaustive or to limit the invention to the precise form disclosed, and obviously many modifications and variations are possible in light of the above teaching. The specific configurations were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A method for achieving relatively low Pd ignition of an ionized gas discharge apparatus, comprising the steps of:

(a) generating a magnetic field in the region between a pair of spaced, opposed, magnetic pole pieces, providing the opposed faces of each of said pole pieces with a recess;

(b) mounting hollow cathode means within one of said recesses, for generating a sheet-type plasma in the region between said pole pieces, and holding said hollow cathode means at a substantially negative potential;

(c) mounting a heat shield within said other recess;

(d) providing means for switching said heat shield between a substantial negative potential and a ground potential;

(e) spacing an anode surface from and operatively associated with said hollow cathode means and heat shield;

(f) providing means for maintaining a pre-selected gas pressure in the region between said pole pieces;

(g) initiating ignition of the apparatus by switching said heat shield to a negative potential to cause the heat shield to act as an auxilliary electrode and to initiate a low-density discharge between the heat shield and the main cathode, whereby the main cathode is heated to start its ignition; and (h) switching said heat shield to a ground potential after the main cathode ignition is achieved.

2. A method as described in claim 1, further comprising the step of mounting an electron emitting filament adjacent to said heat shield.

3. A method as defined in claim 2 including the step of maintaining said gas at a pressure such that the parameter Pd is substantially to the left of the minimum of the Paschen curve for said device.

* * * * *